US007959459B2

(12) United States Patent
Mundt

(10) Patent No.: US 7,959,459 B2
(45) Date of Patent: Jun. 14, 2011

(54) RETRACTABLE INFORMATION HANDLING SYSTEM CABLE

(75) Inventor: Kevin Mundt, Austin, TX (US)

(73) Assignee: Dell Products L.P., Round Rock, TX (US)

( * ) Notice: Subject to any disclaimer, the term of this patent is extended or adjusted under 35 U.S.C. 154(b) by 178 days.

(21) Appl. No.: 12/362,632

(22) Filed: Jan. 30, 2009

(65) Prior Publication Data

US 2010/0197165 A1 Aug. 5, 2010

(51) Int. Cl.
*H01R 13/72* (2006.01)

(52) U.S. Cl. ..... 439/501

(58) Field of Classification Search ..... 439/501, 439/4, 164; 242/385.2, 385.4, 390.1
See application file for complete search history.

(56) References Cited

U.S. PATENT DOCUMENTS

| | | | | |
|---|---|---|---|---|
| 6,059,213 | A * | 5/2000 | Phillips | 242/378.4 |
| 6,392,635 | B1 | 5/2002 | Snyder | |
| 7,004,780 | B1 | 2/2006 | Wang | |
| 7,344,072 | B2 | 3/2008 | Gonzalez et al. | |
| 2005/0170686 | A1 * | 8/2005 | Thorland et al. | 439/501 |
| 2007/0093093 | A1 | 4/2007 | Lev et al. | |
| 2008/0160832 | A1 | 7/2008 | Morganstern et al. | |
| 2008/0235414 | A1 | 9/2008 | Tang et al. | |

* cited by examiner

*Primary Examiner* — Edwin A. Leon
*Assistant Examiner* — Vanessa Girardi
(74) *Attorney, Agent, or Firm* — Garrana Tran LLP; Andrea E. Tran

(57) ABSTRACT

An information handling system disposed within a housing may include a cable coupled to the information handling system. The cable may be configured to move from a retracted position substantially within the housing to an extended position wherein a portion of the cable is external to the housing. Further, a connector end of the cable may be configured to communicatively couple the information handling system to a portable device.

18 Claims, 6 Drawing Sheets

RETRACTABLE INFORMATION HANDLING SYSTEM CABLE

TECHNICAL FIELD

The present disclosure relates generally to the field of information handling systems and, more specifically, to cables for connecting information handling systems to portable devices.

BACKGROUND

As the value and use of information continues to increase, individuals and businesses seek additional ways to process and store information. One option available to users is an information handling system (IHS). An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for such systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

Currently, cables are used to connect and communicate information between various information handling systems and portable devices (e.g., cell phones, personal digital assistants (PDAs), cameras, MP3 players). A cable, such as a communication cable (e.g., universal serial bus (USB), mini-USB), may have a male connector on each end adapted to plug into an information handling system or portable device. Typically, the cable is a component separate from an information handling system and as such, it may be easily misplaced or lost. If lost, the user may not be able to communicate information between information handling systems and portable devices. Thus, a need exists for apparatus and methods for coupling an information handling system to a portable device using an integral communication cable.

SUMMARY

The following presents a general summary of several aspects of the disclosure in order to provide a basic understanding of the disclosure. This summary is merely a general overview of the disclosure and is not intended to identify key or critical elements of the disclosure or to delineate the scope of the claims. The following summary presents some concepts of the disclosure in a general form as a prelude to the more detailed description that follows.

One aspect of the disclosure is an information handling system disposed within a housing, wherein the information handling system is coupled with a cable. The cable may be configured to move from a retracted position substantially within the housing to an extended position wherein a portion of the cable is external to the housing. Further, a connector end of the cable may be configured to communicatively couple the information handling system to a portable device.

Another aspect of the disclosure provides a cable assembly configured to couple to an information handling system. The cable assembly may include a cable configured to move from a retracted position substantially within a housing of the information handling system to an extended position wherein a portion of the cable is external to the housing. The cable assembly may further include a connector end coupled to the cable configured to couple the information handling system to a portable device and a release mechanism adapted to engage and release the connector end from the housing.

Yet another aspect of the disclosure is a method for coupling an information handling system to a portable device. The method may include releasing a connector end of a cable from a housing of the information handling system. The method may also include moving the cable from a retracted position substantially within the housing to an extended position, wherein a portion of the cable is external to the housing. Further, the connector end of the cable may be engaged with the portable device to allow communication of information between the information handling system and the portable device

BRIEF DESCRIPTION OF THE DRAWINGS

For detailed understanding of the present disclosure, references should be made to the following detailed description of the several aspects, taken in conjunction with the accompanying drawings, in which like elements have been given like numerals and wherein.

DETAILED DESCRIPTION

Before the present apparatus, systems and methods are described, it is to be understood that this disclosure is not limited to the particular apparatus, systems and methods described, as such may vary. One of ordinary skill in the art should understand that the terminology used herein is for the purpose of describing possible aspects, embodiments and/or implementations only, and is not intended to limit the scope of the present disclosure which will be limited only by the appended claims.

It must also be noted that as used herein and in the appended claims, the singular forms "a," "and," and "the" may include plural referents unless the context clearly dictates otherwise. Thus, for example, reference to "a cable" may refer to one or several cables, and reference to "a method for coupling" includes reference to equivalent steps and methods known to those skilled in the art, and so forth.

For purposes of this disclosure, an embodiment of an Information Handling System (IHS) may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an IHS may be a personal computer, a storage device, or any other suitable device and may vary in size, shape, performance, functionality, and price. The IHS may include random access memory (RAM), one or more processing resources such as a central processing unit (CPU) or hardware or software control logic, ROM, and/or other types of nonvolatile memory. Additional components of the IHS may include one or more disk drives, one or more network ports for communicating with external devices as well as various input and output (I/O) devices, such as a keyboard, a mouse, and a video display. The IHS may also include one or more buses operable to transmit data communications between the various hardware components.

Figure 1:
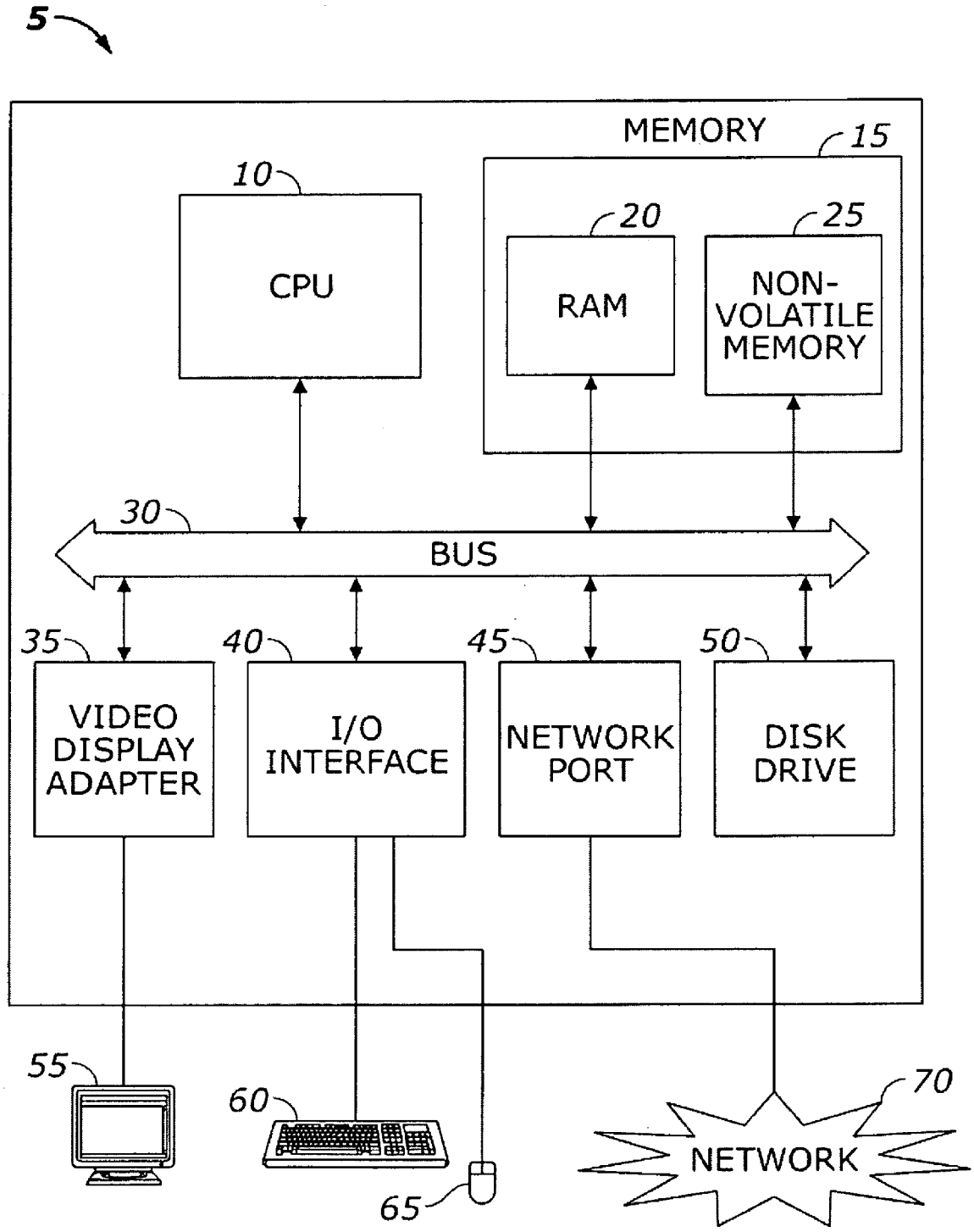
FIG. 1 is a generalized illustration of an information handling system in accordance with one aspect of the present disclosure.

FIG. 1 illustrates one possible implementation of an IHS 5 comprising a CPU 10. It should be understood that the present disclosure has applicability to IHSs as broadly described above, and is not intended to be limited to the IHS 5 as specifically described. The CPU 10 or controller may comprise a processor, a microprocessor, minicomputer, or any other suitable device, including combinations and/or a plurality thereof, for executing programmed instructions. It is appreciated that execution of the algorithm to be described below occurs in the processor or the CPU 10. The CPU 10 may be in data communication over a local interface bus 30 with components including memory 15 and input/output interfaces 40. The memory 15, as illustrated, may include non-volatile memory 25. The non-volatile memory 25 may include, but is not limited to, flash memory, non-volatile random access memory (NVRAM), and electrically erasable programmable read-only memory (EEPROM). The non-volatile memory 25 may contain a firmware program (not shown) which may contain programming and/or executable instructions required to control a keyboard 60, mouse 65, video display 55 and/or other input/output devices not shown here. This type of firmware may be known as a basic input/output system (BIOS). The memory may also comprise random access memory (RAM) 20. The operating system and application programs (e.g., graphical user interfaces) may be loaded into the RAM 20 for execution.

The IHS 5 may be implemented with a network port 45 to permit communication over a network 70 such as a local area network (LAN) or a wide area network (WAN), such as the Internet. As understood by those skilled in the art, IHS 5 implementations may also include an assortment of ports and interfaces for different peripherals and components, such as video display adapters 35, disk drives port 50, and input/output interfaces 40 (e.g., keyboard 60, mouse 65).

Figure 2:
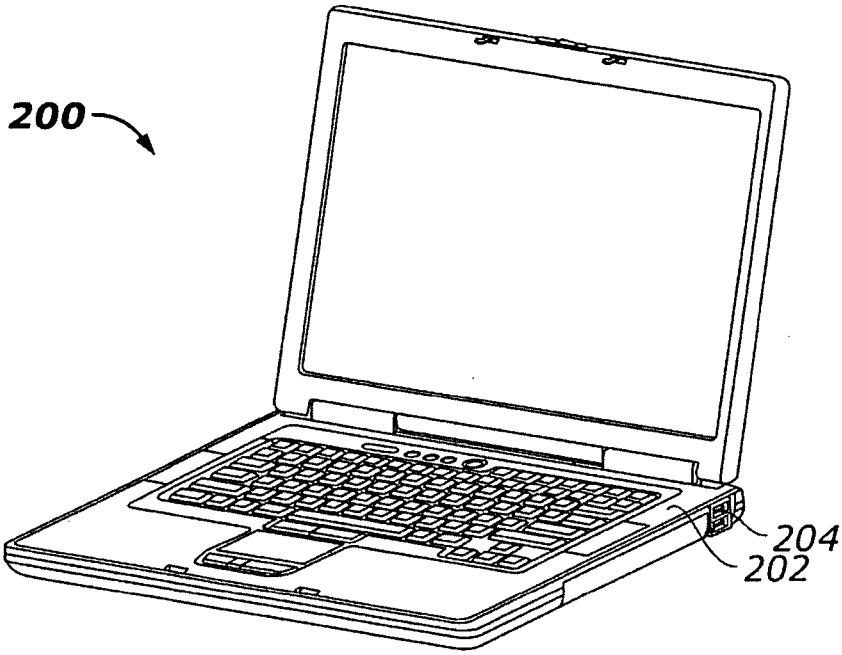
FIG. 2 is a perspective view of a portable information handling system in accordance with one aspect of the present disclosure.

FIG. 2 depicts a portable information handling system (IHS), also commonly referred to as a notebook computer or laptop 200. The laptop 200 may have a cable (e.g., communication cable) configured to extend from or retract into the laptop 200. The communication cable is adapted to couple the laptop 200 to a portable device such as a cell phone, personal digital assistant (PDA), camera, MP3 player, television, projector, global positioning system (GPS) or the like. The cable may be retracted or located substantially within a housing 202 of the laptop 200 when not in use, as shown in FIG. 2. A connector end 204 on one end of the cable may be disposed within the housing 202 when the cable assumes a retracted position. FIG. 2 shows the connector end 204 locked within a release mechanism. The cable with the connector end 204 will remain in a retracted position until a user wishes to communicate information from the laptop 200 to the portable device.

Figure 3:
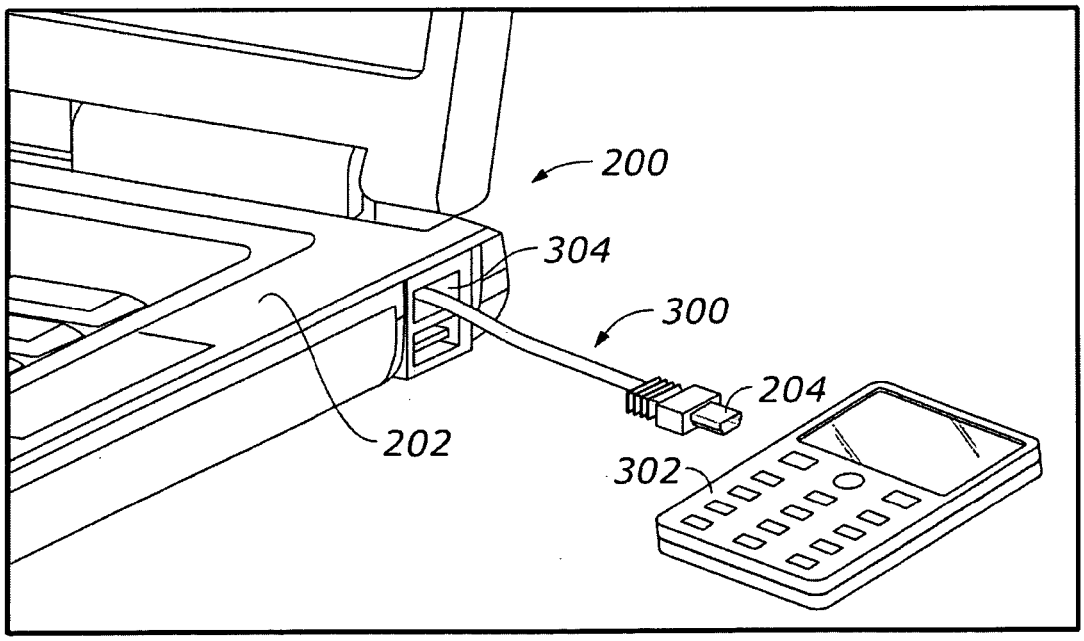
FIG. 3 is a perspective view of a cable extending from an information handling system in accordance with one aspect of the present disclosure.

When a user wishes to connect the laptop 200 to a portable device 302, he may allow the release mechanism to release the connector end 204 from the housing 202 and extend the cable away from the laptop 200. Turning now to FIG. 3, a cable 300 is shown in an extended position from the laptop 200. In the extended position, a portion of the cable 300 has extended out of the housing 202 of the laptop 200. The extended position allows the connector end 204 to be easily manipulated and engaged with a portable device 302. In the extended position, the connector end 204 of the cable 300 may be communicatively coupled to the portable device 302. One end of the cable 300 may remain coupled to the laptop 200 while a second end of the cable 300, i.e., the connector end 204, is manipulated into and out of the laptop 200. The portable device 302 and the laptop 200 may then communicate information and/or data between one another via the cable 300.

The cable 300 may allow the connector end 204 to extend a predetermined distance from the housing 202. In some embodiments, the predetermined distance is at least 10 inches in length. In other embodiments, the predetermined distance from the housing may be equal to or less than five inches in length, and in yet other embodiments, the predetermined length may be about three inches in length. Although the predetermined length may be described as being three inches, it should be appreciated that the predetermined length may be any suitable length depending on the requirements of the user and the arrangement of the information handling system 5.

When the communication of information between the laptop 200 and the portable device 302 is completed, the user may disconnect the connector end 204 from the portable device 302. The user may then place the cable 300 back in a retracted position, as shown in FIG. 2, in order to prevent damage to the cable 300. In some embodiments, the user may position the cable 300 within the housing 202 by pushing the cable 300 through an opening 304 in the housing 202. The connector end 204 may then engage the release mechanism in order to prevent the cable 300 from inadvertently disengaging from the housing 202, as will be described in more detail below. The user may then reengage the connector end 204 with the release mechanism, thereby minimizing the risk of damage to the cable. Generally, the cable 300 may be manually retractable into the laptop 200 by applying pressure to the cable 300 in the direction of the desired retraction. Further, it should be appreciated that any suitable method of retracting (e.g., via a retraction spool) the communication cable may be used.

Figure 4:
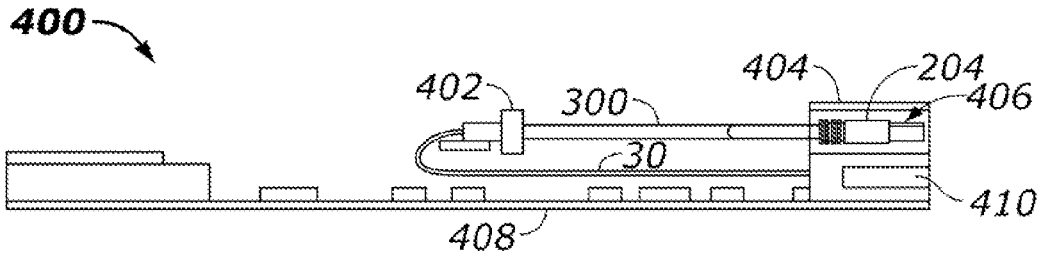
FIG. 4 is a side view of a cable assembly in accordance with one aspect of the present disclosure.

FIG. 4 shows a side view of a cable assembly 400 configured to house the cable. The cable assembly 400 may be configured to be mechanically and communicatively coupled to the IHS. The cable assembly 400 may include the connector end 204, the cable 300, a limit stop 402, a connector housing 404, a release mechanism 406, and a connector assembly housing 408. Further, the cable assembly 400 may be a preassembled device that may be installed into an IHS. The cable assembly 400 may communicatively couple directly to a bus and/or a motherboard of an IHS. Moreover, the cable assembly 400 may include a female connection port 410 adapted to receive a male end, such as from the connector end 204. It should be appreciated that any suitable communication port may be utilized for the connection port 410, examples of which may include universal serial bus (USB), mini-USB or the like.

The connector housing 404 may house the release mechanism 406 and the connector end 204, when the connector end 204 is in the retracted position. The connector housing 404 may secure the release mechanism 406 and provide a location for the connector end 204 to securely remain while in the retracted position. Further, the connector housing 404 may house other features, for example the female connection port 410.

The connector housing assembly 408 may be a preassembled unit which may be easily installed on any IHS. To this end, the connector housing assembly 408 may simply plug into an IHS, thereby allowing the connector end 204 to engage a portable device while the cable 300 communicates information to/from the IHS.

Figure 5:
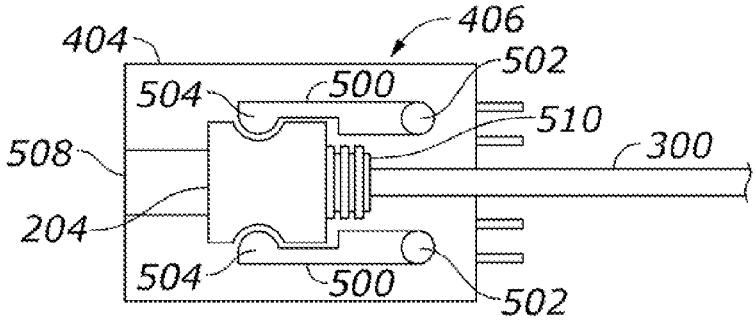
FIG. 5 is a top view of a release mechanism engaged with one end of the cable shown in FIG. 3.

Referring now to FIG. 5, a release mechanism 406 within a connector housing 404 is shown in a locked position, according to one aspect of the present disclosure. The release mechanism 406, as shown, may be in the form of a push-push release mechanism. The push-push release mechanism may include one or more jaws 500. Each of the one or more jaws 500 may include a first biasing member 502, shown schematically. The first biasing member 502 may bias the jaw 500 toward the connector end 204. The first biasing member 502 may be any suitable biasing member including, but not limited to, a coiled spring, a leaf spring and the like. The one or more jaws 500 may further include an anchor member 504. The anchor member 504 may be adapted to engage a profile 506 on the connector end 204. In the locked position, the anchor member 504 is engaged in the profile 506. The first biasing member 502 biases the anchor member 504 toward the profile 506. The first biasing member 502 ensures that the anchor member 504 remains engaged with the profile 506 until the user wishes to release the connector end 204.

Figure 6:
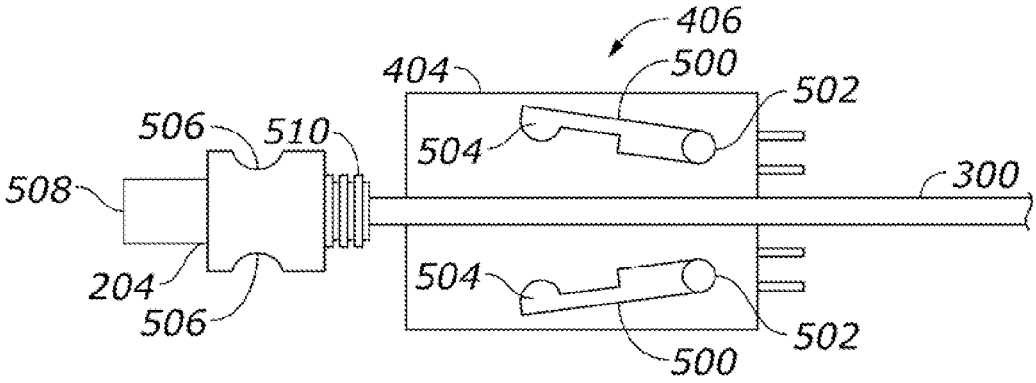
FIG. 6 is a top view of a release mechanism disengaged from one end of the cable shown in FIG. 3.

To release the connector end 204 from the release mechanism 406, the user may apply pressure to the exposed end 508 of the connector end 204 or the button 700. By pushing on the exposed end 508, typically formed of metal or a comparable rigid material, the profile 506 moves the anchor member 504 radially away from the connector end 204. As the anchor member 504 moves radially away from the connector end 204, the one or more jaws 500 release the connector end 204, thereby allowing the connector end 204 to move free of the release mechanism 406, as shown in FIG. 6. The release mechanism 406 may include a second biasing member 510 configured to push the connector end 204 away from the release mechanism 406 once the anchor member 504 is disengaged from the profile 506.

To move the connector end 204 back to the locked position, the user may apply pressure to the connector end 204 toward the connector housing 404. Once the connector end 204 is substantially within the connector housing 404, the user may push the connector end 204 by the exposed end 508 until the anchor member 504 engages with the profile 506. Although the release mechanism 406 is described as being a push-push mechanism, it should be appreciated that the release mechanism 406 may be any suitable method of engaging and disengaging the connector end 204 to the IHS including, but not limited to, a spring a latch, and the like.

In another implementation, a slide latch may serve as a release/retention device. In such a slide latch, the latch with an internal hook may be translated away from the connector body to release the connector end. A mechanism may be employed to eject the connector end from the IHS. Further, an elastic member (e.g., spring) may be used to force the connector end from the chassis of the IHS.

Figure 7:
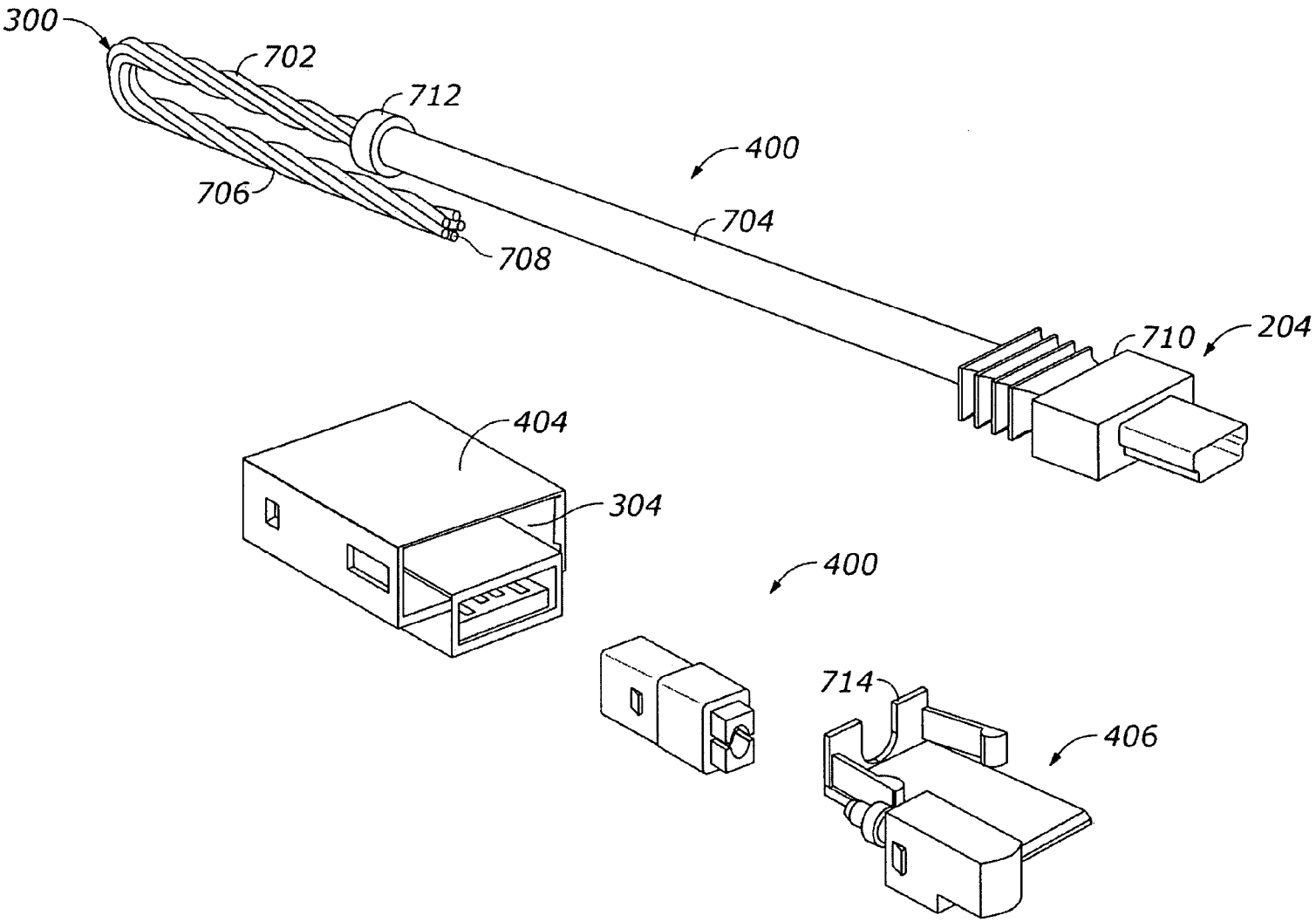
FIG. 7 is a perspective exploded view of the cable assembly shown in FIG. 4.
Figure 8:
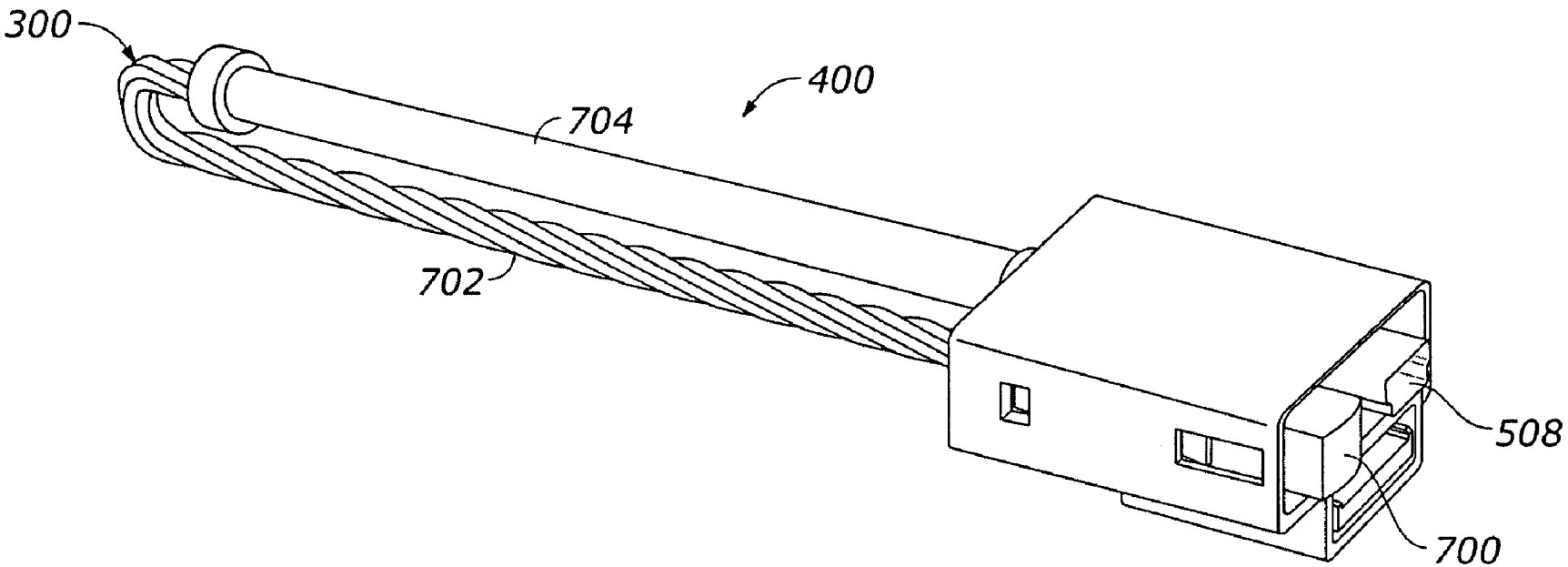
FIG. 8 is a perspective view of the cable assembly shown in FIG. 4.
Figure 9:
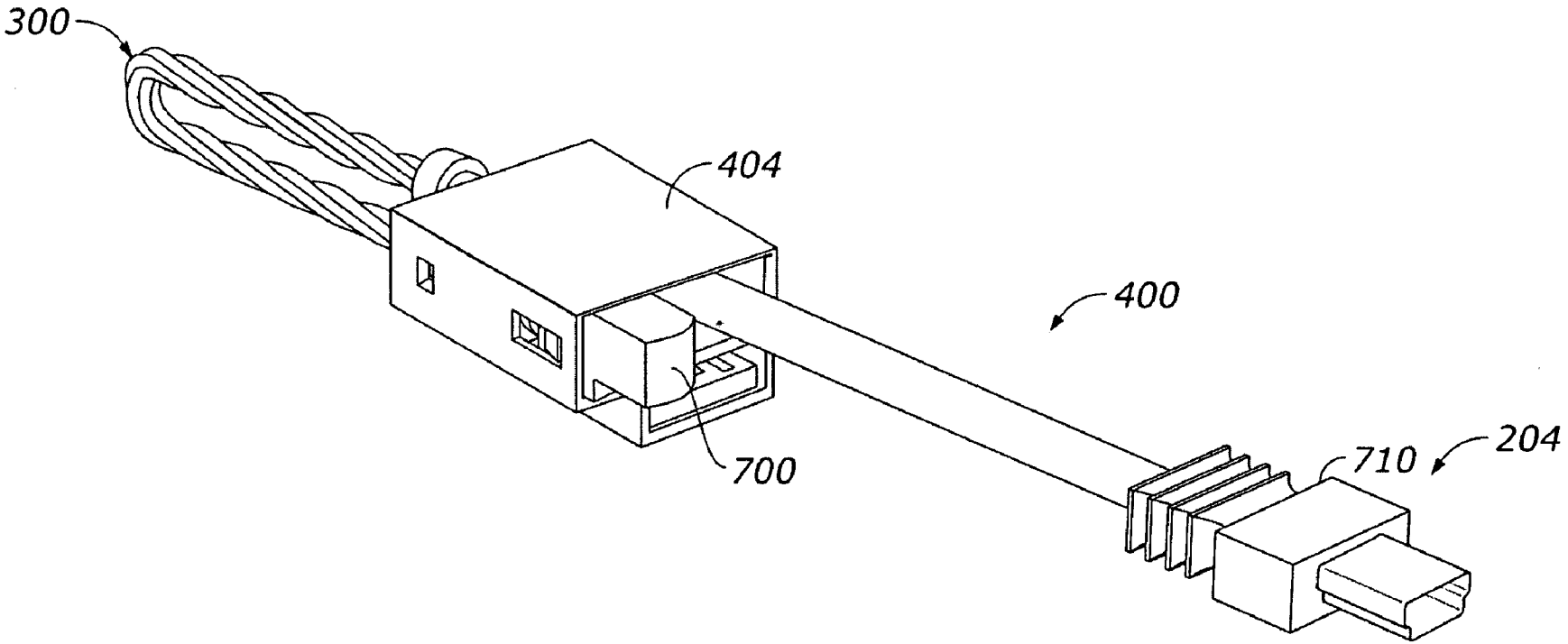
FIG. 9 is another perspective view of the cable assembly shown in FIG. 4.

Generally, a strain relief may provide flexibility to allow the cable 300 to enter the body of the connector (i.e., connector end) without putting stress on the cable/connector interface. The biasing member 510 may serve as the strain relief and may be formed of a rigid material such as plastic or the like. The biasing member 510 may lead into the profile 506, which may be formed from a similar rigid material FIGS. 7-9 present alternate views of a cable assembly, indicated generally at 400. In particular, FIGS. 7-9 depict a button 700 configured to release the connector end 204 from the release mechanism 406. The button 700 operates the push-push mechanism in a similar manner to the push-push mechanism described above. The connector end 204 is shown in the locked position in FIG. 8. In the locked position, the button 700 may be located in a position proximate the exposed end 508. To disengage the release mechanism 406, the user may push the button 700, thereby releasing the anchor member 504 from the profile 506, as shown in FIG. 6. The user may then engage the connector end 204 and thereby the cable 300 with the portable device 302.

As previously mentioned, the cable 300 may be any suitable cable for communicating information between an IHS and a portable device. As shown in FIG. 7, the cable 300 may comprise a plurality of wires 702. In a possible implementation, the cable 300 may include a flexible portion and a substantially rigid portion. The plurality of wires 702 may be disposed within an external jacket 704. The external jacket 704 may form the rigid portion of the cable 300 and protect the portion of the cable 300 that extends outside the housing of the laptop. The external jacket 704 may be made of any suitable material including, but not limited to, plastic, perfluoroalkoxy polymer resin (PFA), vinyl and polyvinyl chloride (PVC). Because the external jacket 704 provides rigidity to the cable 300, a user may more easily push the jacketed portion of the cable 300 back into the housing 202 when the cable 300 is extended. The external jacket 704 may be located only on the portion of the cable 300 which is adapted to extend from the IHS or may located on any portion of the cable 300 including on substantially the entire length of the cable 300.

A bare portion 706 of the cable 300 may extend outside the external jacket 704. The bare portion 706 may be more flexible than the external jacket 704 and thus, may form the flexible portion of the cable 300. When a user pulls the cable 300 out of the housing, the bare portion 706 may allow the cable 300 to easily bend along its length thereby forming a loop as the cable 300 moves inside and outside of the housing 202. Although the cable 300 is described as being a plurality of wires 702 with a bare portion 706 and the external jacketed portion 704, it should be appreciated that any conductor capable of communicating information between an IHS and a portable device may be used including, but not limited to, a flat flex wire, a rigid cable missing a portion of the rigid housing, a flex circuit, and the like.

The end of the cable 300 adapted to couple to the portable device is coupled to the connector end 204. A terminal end 708 of the cable 300 may couple to the motherboard and/or a communication bus of the IHS. The cable 300 may be coupled by any suitable method of coupling conductors including, but not limited to, soldering, crimping, pinning and the like.

The cable 300 may include a limit stop 712 configured to stop the cable 300 from extending beyond a predetermined distance external to the IHS. The limit stop 712 is a larger portion of the cable 300 adapted to engage a catch 714. The catch 714, as shown in FIG. 7, may couple to the release mechanism 406, however, it should be appreciated that the catch 714 may be located in any suitable location, so long as the catch 714 prevents the limit stop 712 from passing a predetermined distance. The limit stop 712 may be formed of any suitable material including, but not limited to, sheet metal, plastic, and the like. The limit stop 712 may be located at any location on the cable 300. In one embodiment, the limit stop 712 may be located to allow approximately three inches of cable to extend from the IHS. It should be appreciated that the limit stop 712 may be located to allow any length of cable 300 to extend from the IHS.

The connector end 204, as shown in FIGS. 2-9, may comprise a mini-universal serial bus (USB) connection. Although described as a mini-USB connector, it should be appreciated that any suitable connector for coupling the IHS to the portable device may be used including a USB, serial AT attachment (SATA), any conventional proprietary cell phone connector or the like. The connector end 204 may include a bridge portion 710. The bridge portion 710 may be formed to engage the release mechanism 406, as described above. Further, the bridge portion 710 may allow a user to easily grip the connector end 204. The bridge portion 710 may be sized to securely fit within the connector housing 404. The connector end 204 may include the second biasing member 510, as described above. The second biasing member 510 may assist the connector end 204 in disengaging the release mechanism 406. As shown, the second biasing member 510 may be a flexible member, formed from a rigid material such as plastic, configured to compress between the connector housing 404 and the bridge portion 710 when the connector end 204 is in the locked position.

In operation, a user may bring a portable device 302, such as a cell phone, proximate the IHS 5. The user may wish to transfer information between the portable device 302 and the IHS 5, and/or charge a battery of the portable device 302. Without using a separate cable, the user may engage the portable device 302 with the IHS 5. Applying pressure to the button 700 on the IHS, as shown in FIGS. 1-9, may cause the release mechanism 406 to disengage the connector end 204. The second biasing member 510 pushes the connector end 204 at least partially out of the release mechanism 406 and thereby the housing 202. With the connector end 204 at least partially out of the housing 202, the user may easily grab the connector end 204. The user may then pull the connector end 204 from the housing 202. As the user pulls the connector end 204, a flexible portion of the cable 300, for example the bare portion 804, may allow the cable 300 to bend as the cable 300 is extended out of the housing 202. The user may continue to pull the cable 300 until the limit stop 712 engages the catch 714. Thus, the limit stop 712 prevents the cable 300 from extending past a predetermined point on the cable 300. The user may then plug the connector end 204 into the portable device 302. With the connector end 204 engaged with the IHS 5, the user may transfer information between the IHS 5 and the portable device 302.

When the user is finished transferring information, the user may disengage the connector end 204 from the portable device 302. The user may then move the connector end 204 toward the housing 202. As the connector end 204 moves toward the housing 202, a rigid portion of the cable 300, for example the external jacketed portion 704, provides enough rigidity to the cable 300 to push the cable 300 back into the housing 202. Meanwhile, the flexible portion of the cable 300 allows the cable 300 to bend inside the housing 202. The user may continue to push the connector end 204 toward the housing 202 until the connector end 204 engages the release mechanism 406. The release mechanism 406 may automatically engage the connector end 204, thereby locking the connector end 204 securely in the release mechanism 406. The cable 300 and the connector end 204 are then safely located substantially within the housing 202. The user may then safely transport the IHS 5 without damaging the cable 300, or needing to bring a separate cable with the IHS 5.

Although the present disclosure has been described with reference to particular examples, embodiments and/or implementations, those skilled in the art will recognize that modifications and variations may be made without departing from the spirit and scope of the claimed subject matter. Such changes in form and detail, including use of equivalent functional and/or structural substitutes for elements described herein, fall within the scope of the appended claims and are intended to be covered by this disclosure.

What is claimed is:

1. An information handling system disposed within a housing, the system comprising:

a cable coupled to the information handling system, wherein the cable is configured to move from a retracted position substantially within the housing to an extended position wherein a portion of the cable is external to the housing, wherein a connector end of the cable is configured to communicatively couple the information handling system to a portable device, wherein the cable is movable to the retracted position by pushing the connector end of the cable toward the housing; and a release mechanism configured to release and engage the connector end of the cable.

2. The information handling system of claim 1, further comprising a limit stop coupled to the cable and configured to limit travel of the cable to a fixed distance external to the housing.

3. The information handling system of claim 1, wherein the connector end is a universal serial bus (USB) connector or a mini-USB connector.

4. The information handling system of claim 1, wherein the portable device is a cell phone.

5. The information handling system of claim 1, wherein the portable device is an MP3 player.

6. The information handling system of claim 1, wherein the release mechanism is a push-push mechanism.

7. The information handling system of claim 1, wherein the cable further comprises a flexible cable portion and a rigid cable portion, wherein the flexible cable portion is configured to allow the cable to move from the retracted position to the extended position.

8. The information handling system of claim 7, wherein the flexible cable portion is coupled to a bus of the information handling system.

9. A cable assembly configured to couple to an information handling system, the cable assembly comprising:

a cable configured to move from a retracted position substantially within a housing of the information handling system to an extended position wherein a portion of the cable is external to the housing;

a connector end coupled to the cable configured to couple the information handling system to a portable device, wherein the cable is movable to the retracted position by pushing the connector end of the cable toward the housing; and a release mechanism adapted to engage and release the connector end from the housing.

10. The cable assembly of claim 9, wherein the connector end further comprises a universal serial bus (USB) connector or a mini-USB connector.

11. The cable assembly of claim 9, wherein the release mechanism further comprises a push-push release mechanism.

12. The cable assembly of claim 9 further comprising a universal serial bus (USB) port or mini-USB port.

13. The cable assembly of claim 9 further comprising a limit stop coupled to the cable and configured to limit travel of the cable to a fixed distance external to the housing.

14. The cable assembly of claim 9, wherein the cable further comprises a substantially rigid cable portion and a flexible cable portion, the flexible cable portion configured to allow the cable to bend as the cable moves from the extended position to the retracted position.

15. The cable assembly of claim 14, wherein a portion of the flexible cable portion is coupled to a bus of the information handling system.

16. A method for coupling an information handling system to a portable device, the method comprising:

releasing a connector end of a cable from a housing of the information handling system via a release mechanism;

moving the cable from a retracted position substantially within the housing to an extended position, wherein a portion of the cable is external to the housing; engaging the connector end of the cable with the portable device to allow communication of information between the information handling system and the portable device; and retracting the cable to the retracted position by pushing the connector end of the cable toward the housing.

17. The method of claim 16, wherein releasing the connector end further comprises applying pressure to a button of a push-push mechanism.

18. The method of claim 16, wherein the cable is coupled to a limit stop configured to limit the travel of the cable to a fixed distance external to the housing.

* * * * *